US012241315B2

(12) United States Patent
Peralez et al.

(10) Patent No.: US 12,241,315 B2
(45) Date of Patent: Mar. 4, 2025

(54) MULTILINE RISER BIG BORE CONNECTOR

(71) Applicant: Hydril USA Distribution LLC, Houston, TX (US)

(72) Inventors: Andrew Peralez, Houston, TX (US); Antonio Medina, Houston, TX (US); Eric Larson, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 0 days.

(21) Appl. No.: 18/492,244

(22) Filed: Oct. 23, 2023

(65) Prior Publication Data

US 2024/0133251 A1 Apr. 25, 2024
US 2024/0229575 A9 Jul. 11, 2024

Related U.S. Application Data

(60) Provisional application No. 63/418,353, filed on Oct. 21, 2022.

(51) Int. Cl.
*E21B 17/01* (2006.01)
*E21B 19/00* (2006.01)
*E21B 21/08* (2006.01)

(52) U.S. Cl.
CPC ..... *E21B 19/004* (2013.01); *E21B 17/01* (2013.01)

(58) Field of Classification Search
USPC ..... 166/367
See application file for complete search history.

(56) References Cited

U.S. PATENT DOCUMENTS 3,791,442 A 2/1974 Watkins
4,405,162 A * 9/1983 Williams ..... F16L 39/06 285/190

(Continued)

FOREIGN PATENT DOCUMENTS

WO WO-2012177713 A2 * 12/2012 ..... E21B 33/038

OTHER PUBLICATIONS

International Search Report issued in corresponding International Application No. PCT/US 23/35721 mailed Jan. 31, 2024 (2 pages).

(Continued)

*Primary Examiner* — Matthew R Buck
*Assistant Examiner* — Douglas S Wood
(74) *Attorney, Agent, or Firm* — Osha Bergman Watanabe & Burton LLP

(57) ABSTRACT

A system connecting one more flow lines and includes a connector housing and a connector. The connector housing comprises a first connection passage formed through a wall of the connector housing. The connector is disposed withing the connector housing. A first annular flow path connection is formed between the connector housing and the connector. The first housing annular flow path connection is formed by a first housing annular flow path connection groove. The first housing annular flow path connection groove is formed in an outer side surface of the connector. Alternatively, the first annular flow path connection is formed by a combination of the first housing annular flow path connection groove axially aligned with the first connector annular flow path connection groove. The first connection passage through the connector housing intersects with the first annular flow path connection. A related method includes connecting inserting the connector into the connector housing.

18 Claims, 7 Drawing Sheets

(56) References Cited

U.S. PATENT DOCUMENTS

| | | | | | |
|---|---|---|---|---|---|
| 4,502,543 | A * | 3/1985 | Outhwaite | F16J 15/025 166/359 |
| 4,669,758 | A * | 6/1987 | Feller | F16L 39/06 285/94 |
| 5,072,130 | A * | 12/1991 | Dobson | G06N 3/063 706/26 |
| 5,697,732 | A * | 12/1997 | Sigmundstad | B63B 22/026 166/345 |
| 5,702,130 | A * | 12/1997 | Jostein | F16L 39/06 285/121.6 |
| 5,895,077 | A * | 4/1999 | Sigmundstad | F16L 27/087 285/121.5 |
| 7,726,405 | B2 * | 6/2010 | McMiles | F16L 55/05 166/85.4 |
| 9,650,855 | B2 * | 5/2017 | Caldwell | E21B 33/038 |
| 2013/0168102 | A1 | 7/2013 | Baker | |
| 2020/0157896 | A1 * | 5/2020 | Webb | E21B 21/08 |

OTHER PUBLICATIONS

Written Opinion issued in corresponding International Application No. PCT/US 23/35721 mailed Jan. 31, 2024 (10 pages).

* cited by examiner

MULTILINE RISER BIG BORE CONNECTOR

BACKGROUND

In offshore drilling operations, a floating structure, such as a platform or vessel, may be stationed at water level above a well location at the sea floor. A blowout preventor (BOP) stack may be installed at the well head, which may be used to control fluid flow from the well. A drill string is extended from the floating structure to the well location to drill a well into a formation below the sea floor. During drilling, drilling fluid, also referred to as "drilling mud" or simply "mud," is used to facilitate drilling boreholes into the earth, and may be circulated through the drill string, through the well being drilled, and returned to the surface. Offshore drilling systems may be configured differently, depending on the drilling location and other operational parameters, to circulate drilling fluid through the drilling system using different components and component arrangements.

In many offshore drilling systems, a drill string is run through a riser (in a coaxial configuration) to extend from the floating structure to the well. In such systems, drilling fluid may be pumped through the drill string into the well and returned around the drill string through the riser. In some drilling systems, referred to as open water drilling, a drill string and riser may be extended from the floating structure to the well in a spaced apart, non-coaxial configuration. In such configurations, the drilling fluid return annulus through the well may be fluidly connected to the riser via one or more pipe and/or hose connections. Drilling fluid may then be pumped through the drill string into the well and returned through the riser.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate generally to systems and methods that utilize a connector, as described herein, to connect a riser to a BOP stack.

In another aspect, embodiments disclosed herein relate generally to systems and methods that utilize a connector with multiple bores machined into a cylindrical forging to form a fluid connection to a mating female receptacle on a different assembly without any existing structural connection.

In another aspect, embodiments disclosed herein relate generally to systems and methods that utilize a system to connect one or more flow lines. In some embodiments, the system includes a connector housing and a connector. The connector housing may comprise a first connection passage formed through a wall of the connector housing. The connector may be disposed withing the connector housing. A first annular flow path connection may be formed between the connector housing and the connector. The first housing annular flow path connection may be formed by a first housing annular flow path connection groove. The first housing annular flow path connection groove may be formed in an outer side surface of the connector. Alternatively, the first annular flow path connection may be formed by a combination of the first housing annular flow path connection groove axially aligned with the first connector annular flow path connection groove. The first connection passage through the connector housing may intersect with the first annular flow path connection.

In another aspect, embodiments disclosed herein relate generally to methods for connecting a riser to a BOP stack that includes providing a connector housing connected to the BOP stack, the connector housing comprising a first connection passage formed through a wall of the connector housing. The method further includes connecting the riser to a connector via a riser connection. The connector comprises a first bore formed through a body of the connector. The method further includes inserting the connector into the connector housing. Once the connector is inserted into the connector housing, a first annular flow path connection is formed between the connector housing and the connector by a first housing annular flow path connection groove. The first housing annular flow path connection groove may be formed in an inner surface of the connector housing. A first connector annular flow path connection groove may be formed in an outer side surface of the connector, or a combination of the first housing annular flow path connection groove axially aligned with the first connector annular flow path connection groove. The first connection passage through the connector housing may intersect with the first annular flow path connection. The first bore may be in fluid communication with the first annular flow path connection.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Embodiments of the present disclosure are described below in detail with reference to the accompanying figures. In the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description.

Embodiments of the present disclosure relate generally to methods and equipment for connecting one or more flow lines using a single connector. For example, connectors disclosed herein may include a body having multiple bores machined therethrough, which may be fluidly connected to annular flow path connections formed between the connector and a connector housing when the connector is inserted into the connector housing.

A connector housing may have a female shape that mates with a male shape of the connector body, such that the connector housing may act as a receptacle to receive the connector. According to embodiments of the present disclosure, a connector housing may be assembled to various types and configurations of structures, thereby allowing connection on different types of assemblies. For example, connector housings according to embodiments of the present disclosure may be mounted to different types and configurations of BOP stacks without pre-formed structural connections. In such manner, connector housings may be attached to various structures (e.g., using bolts, welding, or other post manufacturing attachment techniques) to allow a connector, as disclosed herein, to fluidly connect to different assemblies. In some embodiments, a connector housing may be integrally formed in a structure or connected to a structure during manufacturing of the structure.

Figure 1:
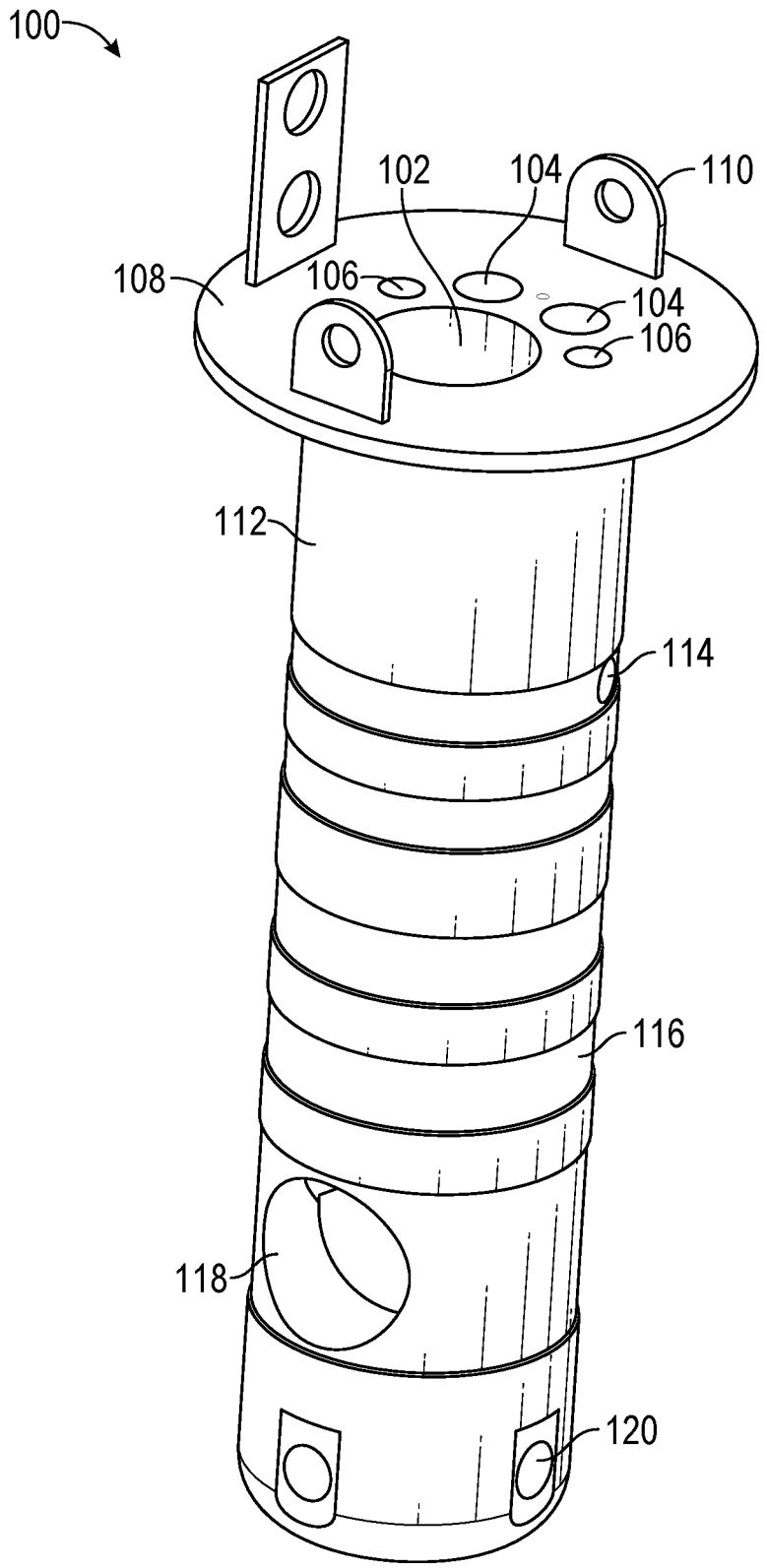
FIG. 1 shows a connector according to embodiments of the present disclosure.
Figure 2:
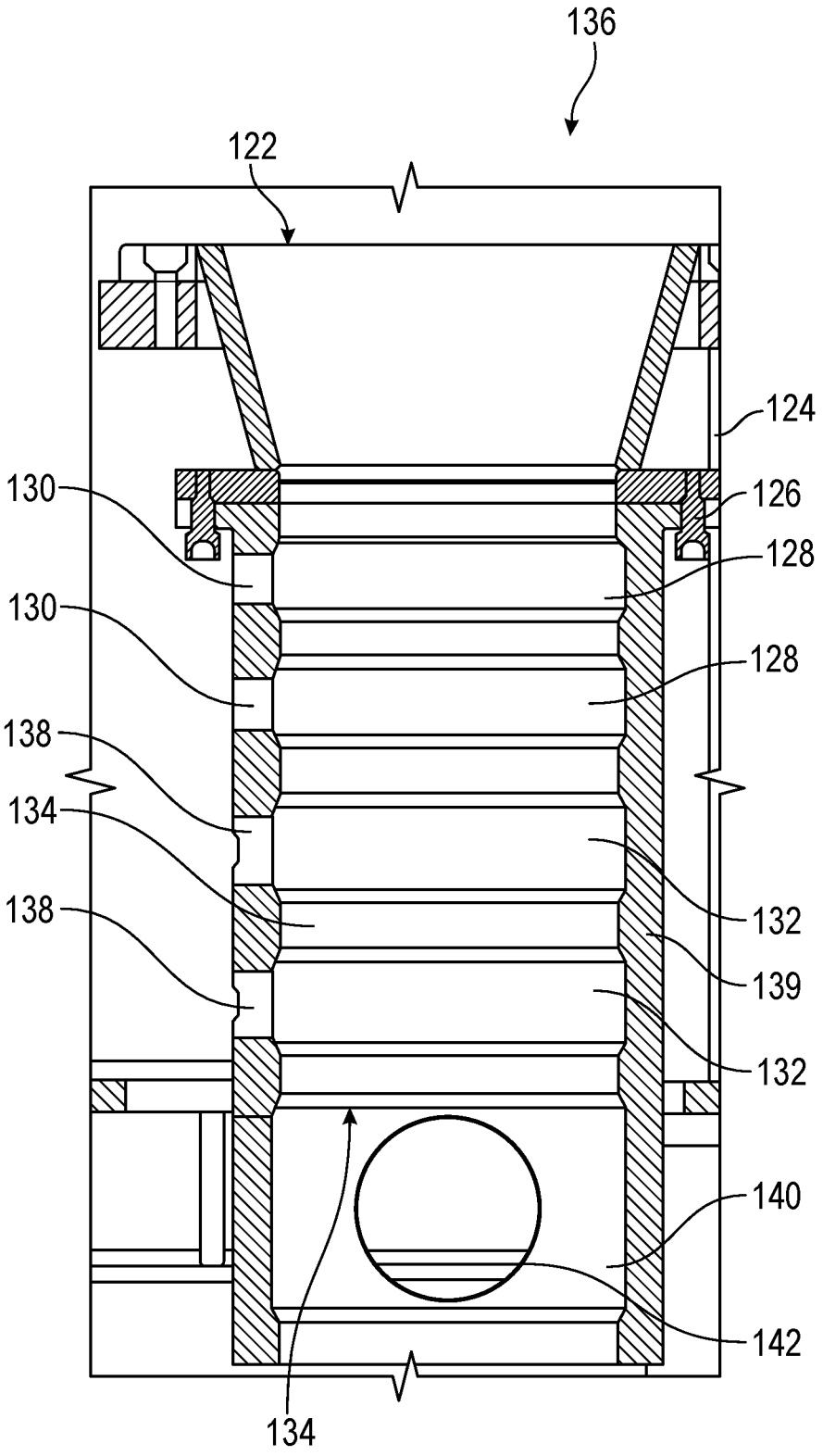
FIG. 2 shows a connector housing according to embodiments of the present disclosure.
Figure 3:
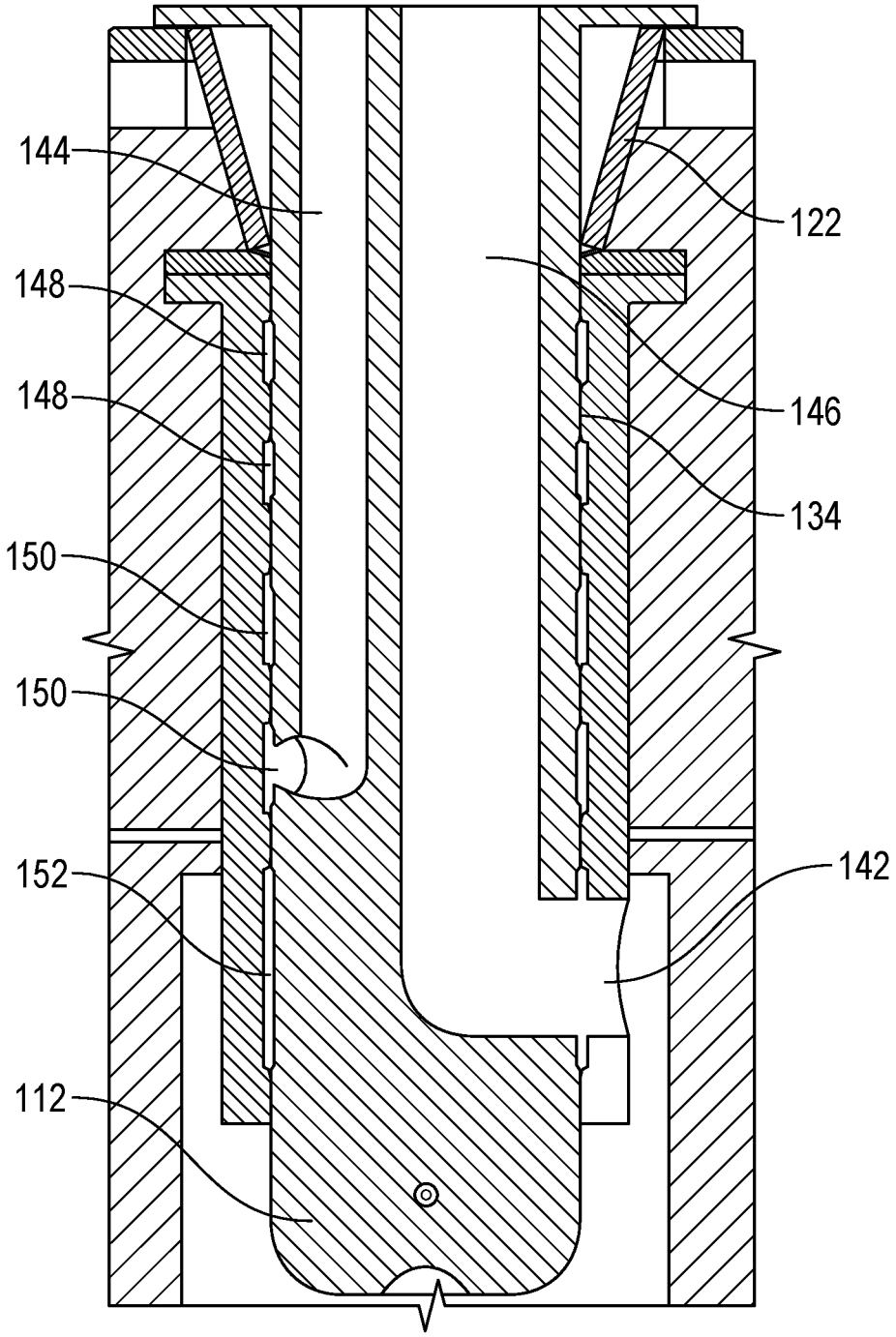
FIG. 3 shows a cross-sectional view of a connector connected to a connector housing according to embodiments of the present disclosure.
Figure 4:
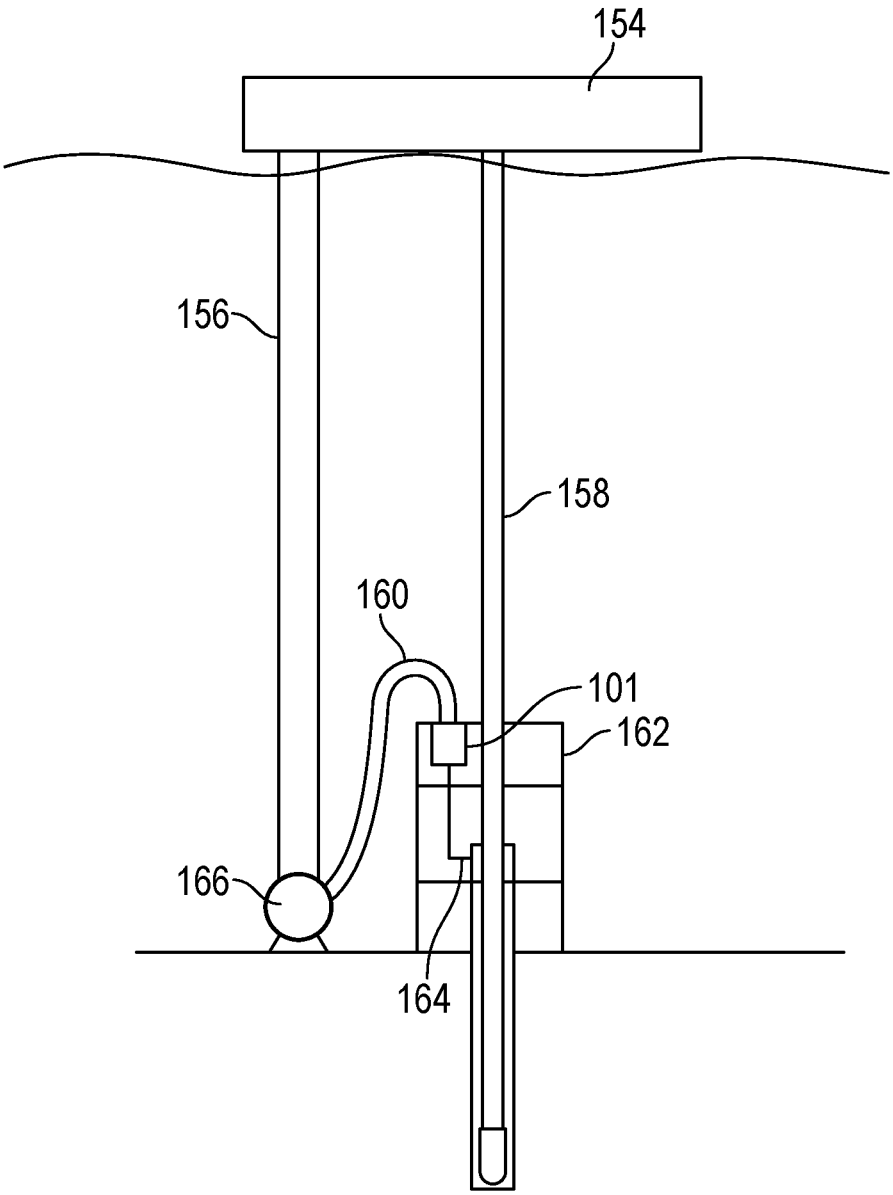
FIG. 4 shows an open water drilling system according to embodiments of the present disclosure.
Figure 5:
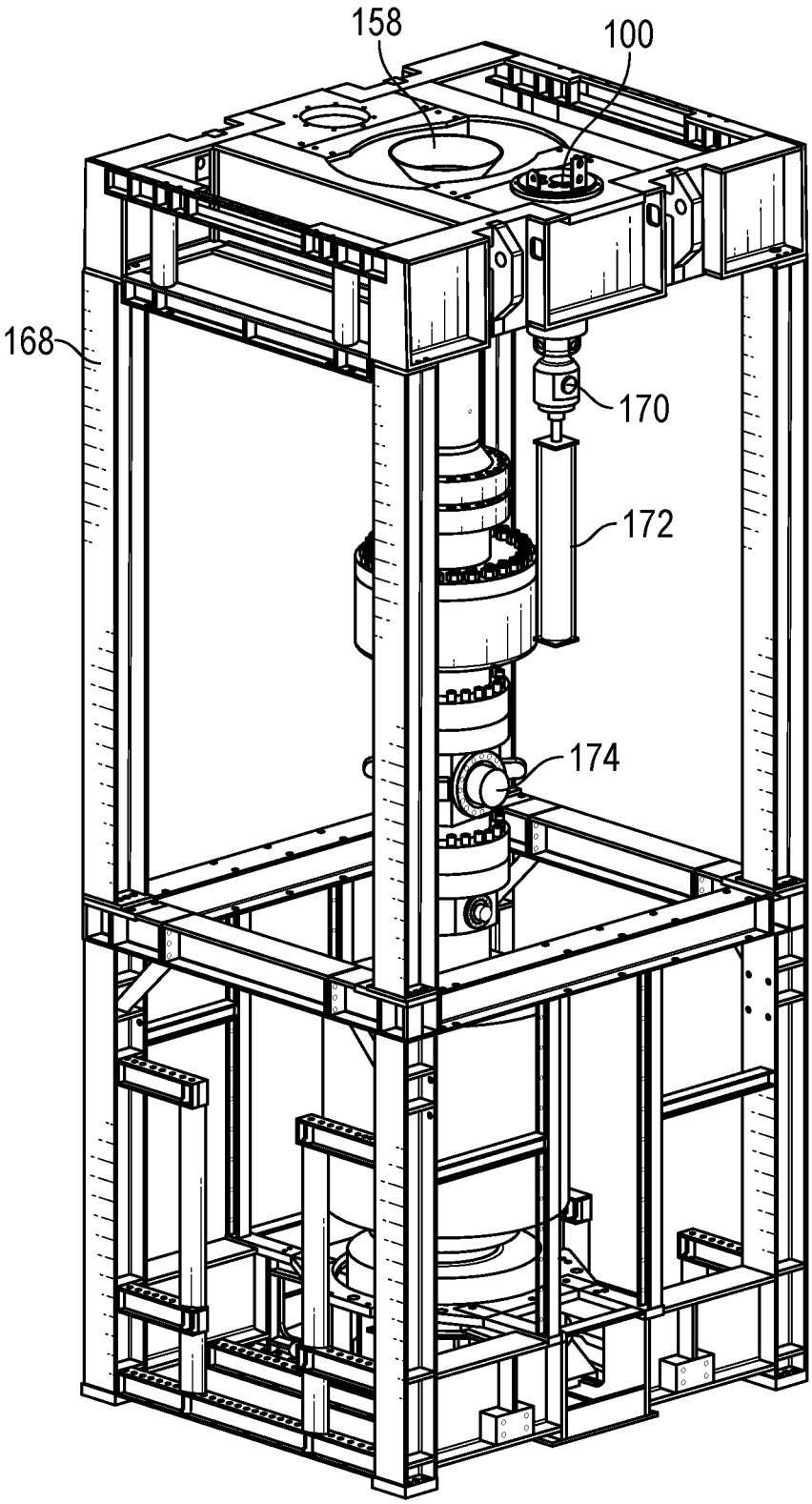
FIG. 5 shows a BOP stack having a connector assembly assembled thereto according to embodiments of the present disclosure.

FIGS. 1-3 collectively show an example of a connector (100), a connector housing (136), and connection between the connector (100) and connector housing (136) according to embodiments of the present disclosure. The connector (100) may have a generally cylindrical body (112) that may be forged from a metal or metal composite and one or more bores machined or otherwise formed through the body (112). In the embodiment shown, multiple bores having different bore diameters are formed through the body (112), including a first bore (146) having a first diameter, second bores (144) having a second diameter, and third bores having a third diameter. However, other combinations and sizes of bore(s) may be formed through a connector (100).

The bore(s) may open at one end on a top (108) of the connector (100) and may open at an opposite end around the body (112) of the connector (100). For example, as shown in FIG. 1, the third bores may open at third bore inlets (114) around the body (112) of the connector (100) and at third bore outlets (106) at the top (108) of the connector (100). Similarly, the second bores (144) may open at second bore inlets around the body (112) of the connector (100) and at second bore outlets (104) at the top (108) of the connector (100), and the first bore (146) may open at a first bore inlet (118) around the body (112) of the connector (100) and at a first bore outlet (102) at the top (108) of the connector (100). The openings to the bores through the connector (100) are referred to herein as "inlet" and "outlet" merely for distinction between the different openings. Depending on the direction of fluid flow through the connector bores, the openings may act as either an inlet or an outlet. Additionally, a bore may extend from a single opening at the top (108) of the connector (100) to a single opening around the body (112) of the connector (100) (e.g., as best shown in FIG. 3), or a bore may extend from a single opening at the top (108) of the connector (100) and branch to two or more openings around the body (112) of the connector (100) (or vice versa).

A connector housing may be configured to receive and mate with a connector (100) to form fluid connections with the bore(s) formed through the connector (100). According to embodiments of the present disclosure, a connector housing may have a generally tubular shape. Connector housings may be attached to other structures (124), such as subsea drilling equipment, using bolts (126), welding, clamps, or other fastening elements. In some embodiments, a guide funnel (122) may be attached to a top end of the connector housing, which may be used to guide a connector (100) into the connector housing.

According to embodiments of the present disclosure, a connector housing may have one or more annular flow path connections that may fluidly connect with one or more bore openings formed around a side of a connector body (112). The annular flow path connections may be formed as grooves around an inner surface of the connector housing (where the inner diameter of the annular flow path connection(s) is greater than the inner diameter of the connector housing inner surface).

For example, as shown in FIG. 2, a connector housing may have a first housing annular flow path connection groove (140) formed around the inner surface of the connector housing at a first axial position, second annular flow path connection grooves (132) formed at different axial positions around the inner surface of the connector housing, and third annular flow path connection grooves (128) formed at different axial positions around the inner surface of the connector housing. Seals (or alternatively, sealing surfaces) (134) extending around the entire inner surface diameter of the connector housing may be provided axially between annular flow path connection grooves to separate and seal the annular flow path connections. For example, seals or sealing surfaces (134) may have an inner diameter less than the inner diameters of adjacent annular flow path connection grooves, where the inner diameter of the seal or sealing surface (134) may seal against a side surface of a connector body when the connector (100) is inserted into the connector housing (136).

In some embodiments, in addition to or alternative to annular flow path connection(s) being formed by grooves around an inner surface of the connector housing (136), annular flow path connection(s) may be formed by grooves formed around the side surface of the connector body (112). For example, as shown in FIG. 1, groove(s) may extend circumferentially around the entire perimeter of the connector body (112) side surface, where the diameter of the body (112) at the annular flow path connection groove(s) (116) are less than the diameter of the body (112) outer side surface. In embodiments where annular flow path connection grooves (116) are formed in both the connector housing inner surface and the connector body (112) side surface, the connector (100) and connector housing (136) may be designed to have corresponding annular flow path connection grooves (e.g., 116, 132, 128, 140) axially align to provide an annular flow path connection between the connector (100) and connector housing (136) when assembled together.

Passages (or alternatively, fluid connection passages) through the connector housing wall (139) may be formed to provide fluid access to each annular flow path connection. For example, as shown, a first connection passage (142) may be formed through the connector housing wall (139) and intersect with the first annular flow path connection (152); second connection passages (138) may be formed through the connector housing wall (139) and intersect with each of the second annular flow path connections (150); and third connection passages (130) may be formed through the connector housing wall (139) and intersect with each of the third annular flow path connections (148). Flanges or other pipe connections to the connection passages may be provided around the outer surface of the connector housing (136) to fluidly connect the annular flow path connections with piping, hosing, or other flow paths of different equipment.

As shown in FIG. 3, when a connector (100) is inserted into the connector housing (136), bore openings around the side of the connector body (112) may be axially aligned with annular flow path connections formed in the connector housing (136). In such manner, fluid may flow through connection passage(s) formed through the connector housing wall (139), through annular flow path connections formed between the connector housing (136) and connector (100), and through fluidly connected bores formed through the connector body (112).

According to embodiments of the present disclosure, bores may have a right turn (or near 90-degree turn) to extend from the top (108) of the connector (100) to a side of the body (112) of the connector (100). Such configuration may reduce pressure end load commonly associated with large bore (e.g., bores having diameters of about 5⅛ inches or more) connections, thereby reducing the required fixturing. For example, according to embodiments of the present disclosure, a first bore (146) may be formed through a connector (100) to provide a drilling fluid return path, and may have a large bore diameter of sufficient size to carry the returning drilling fluid, e.g., a diameter of 7 inches or more. Additionally, connector (100) and bore geometry disclosed herein and shown in the figures may allow for scalable and configurable designs based on end-user needs and applications.

According to embodiments of the present disclosure, connectors (100) and connector housings (136) disclosed herein may be used for connections in BOP stacks and mechanical controls, risers, and any fluid connections. In some embodiments, connectors (100) and connector housings (136) according to embodiments of the present disclosure may be used to connect a riser to a BOP stack.

For example, referring collectively to FIGS. 4-7, systems and methods according to embodiments of the present disclosure may include using a connector and connector housing assembly (e.g., as shown in FIGS. 1-3) to connect a riser (156) to a BOP stack (162).

A BOP stack (162) may be provided at a well head on the sea floor. A floating structure (154) (e.g., a floating platform, vessel, or semi-submersible) may be stationed at the sea surface generally above the well. A drill string (158) may be extended from the floating structure (154), through the BOP stack (162), and into the well to drill the well. A return line (164) may be connected between a fluid outlet (174) to the well and a connector assembly (101) (e.g., as shown in FIG. 3 including a connected connector (100) and connector housing (136)). A riser connection (160) (e.g., a flexible hose) may connect the connector assembly to a riser (156), and the riser (156) may extend to the floating structure (154).

During drilling operations, drilling fluid may be pumped through the drill string (158) to the bottom of the well to aid in drilling. When the drilling fluid exits the bottom of the drill string (158) (e.g., through a drill bit or other bottom hole assembly tool), the drilling fluid may return to the top of the well through a well annulus formed between the drill string (158) and well wall. The returning drilling fluid may then be directed out a fluid outlet (174), through the return line (164) connection, through the connector (100) assembly, through the riser connection (160), and back through the riser (156). In some embodiments, a pump (166) may be provided along the riser (156) to aid in pumping returning drilling fluid to the floating structure (154).

The connector assembly (101) may be provided on the BOP stack (162), for example, by first providing the connector housing (136) on the BOP stack (162). For example, the connector housing (136) may be attached to the BOP stack frame (168). In some embodiments, the connector housing (136) may be attached to an upper end of the BOP stack (162), which may provide more room for remote operated vehicles (ROVs) to help with assembly and/or more room for connections to the riser connection (160) and other equipment. With the connector housing (136) provided on the BOP stack (162), a connector (100) may be inserted (bottom end first) into a top end of the connector housing (136) and axially moved into the connector housing (136) until the connector (100) and connector housing (136) are mated and interface each other.

In some embodiments, a winching system may be used to pull the connector into the connector housing (136). For example, in some embodiments, a winch assembly (170) may be provided with a BOP stack (162). The stack mounted winching system may allow for an ROV to reel in any component that may present a large resistance greater than the ROV thruster capacity.

Figure 6:
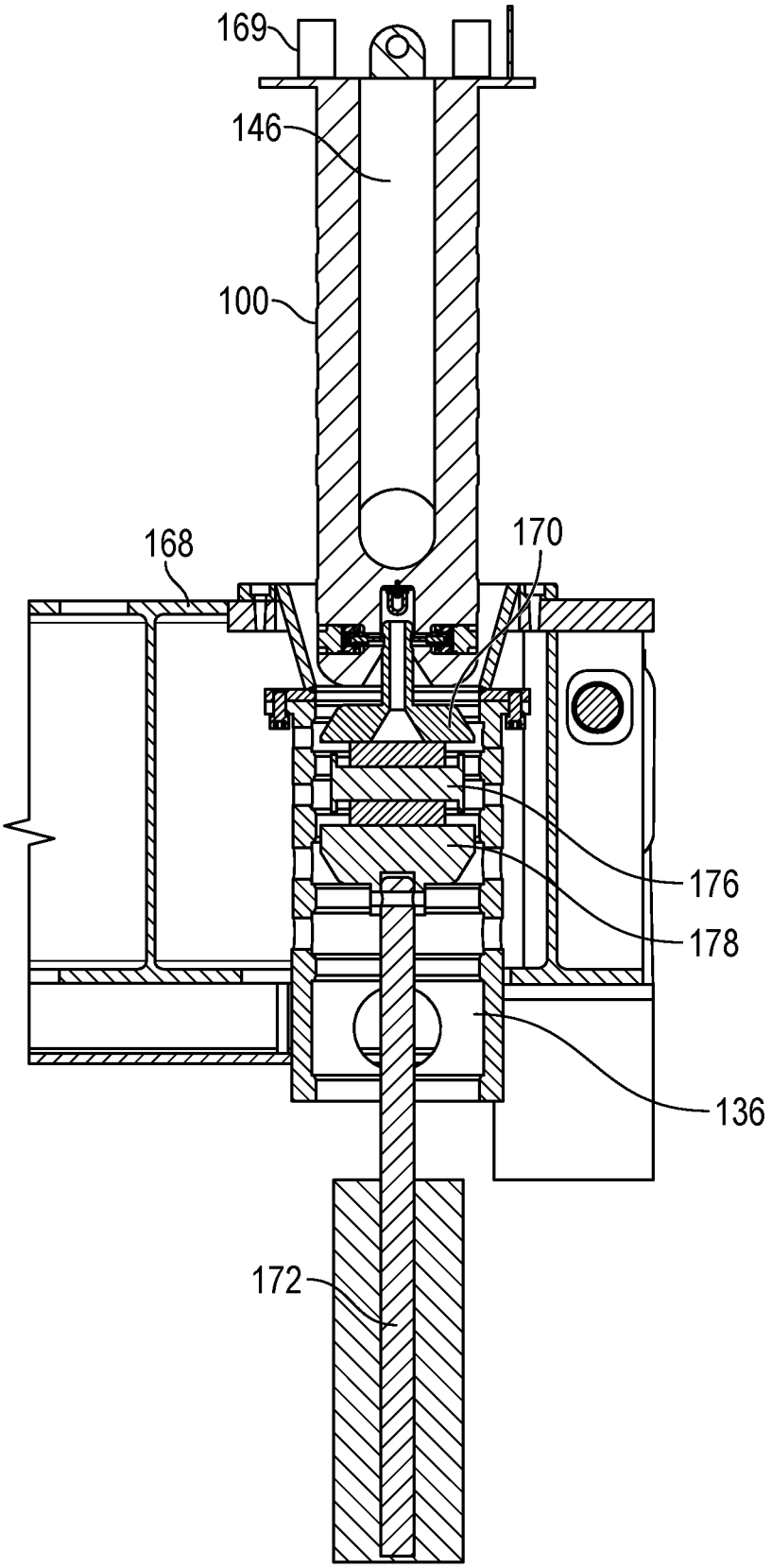
FIGS. 6 and 7 show a connect/disconnect sequence according to embodiments of the present disclosure.
Figure 7:
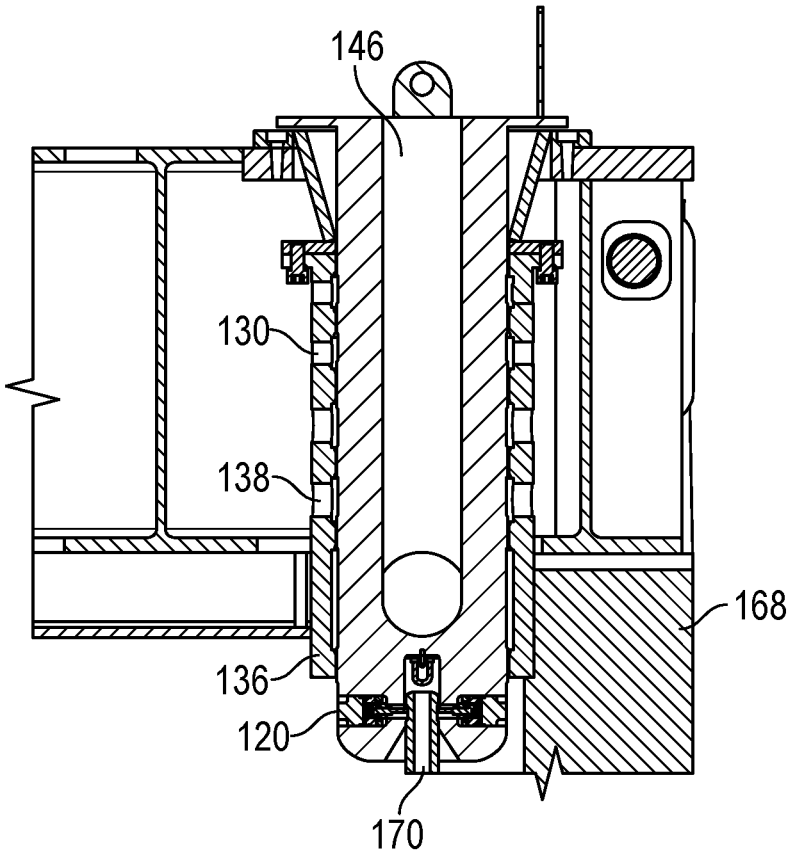

According to embodiments of the present disclosure, a stack mounted subsea winching system may be provided with the BOP proximate a lower end of a connector housing (136). A connector (100) may be moved proximate the connector housing (136), for example, using an ROV. As best shown in FIG. 6, an upper end of a winch assembly (170) may be connected to a bottom end of the connector, e.g., using one or more latches (120) as shown in FIGS. 1 and 7. Using a connected hydraulic piston (172), the winch (176) may be connected to a winch housing (178) and may pull the connector (100) into the connector housing (136) until the bore openings in the side of the connector (100) are axially aligned with the annular flow path connections between the connector (100) and connector housing (136).

To disconnect the connector (100) from the connector housing (136), the winch assembly (170) may be released from the connector (100), e.g., by releasing the winch latches (120). In some embodiments, a buoyancy assisted disconnect feature may be provided, which requires minimal amount of force to break the connection, in most configurations. To achieve a buoyancy assisted disconnect feature, one or more buoyancy modules (169) may be attached to the top of the connector (100). A buoyancy module (169) may be formed from a foam (e.g., polystyrene foam), where the foam composition may be designed to provide a selected density. Other configurations may require additional intervention to break a connection (e.g., using an ROV, breakaway, rig controlled, etc.).

In some embodiments, multiple bores formed through a connector (100) may be used to provide multiple flow paths for different types of fluids. For example, referring to FIGS. 1-3, a first bore (146) (having a large diameter) may be used to form part of a drilling fluid return, where drilling fluid returning from the well may be directed from the well to a riser (156) through the first bore (146). The second bores (144) may be used to form part of different choke lines (having choke fluid flowing therethrough), and the third bores may be used to form part of different hydraulic lines (having hydraulic fluid flowing therethrough). As mentioned above, the bores through the connector (100) may have different diameters, which may be used to accommodate different fluids and for different applications (e.g., to form hydraulic lines or choke lines). Accordingly, in some embodiments, the annular flow path connections formed between the connector (100) and connector housing (136) may likewise have different sizes to accommodate different fluids.

In some embodiments, a riser connection (160) may include a bundle of hoses, where each hose may be connected at the top (108) of the connector (100) to fluidly connect with the bores formed through the connector (100). For example, in the embodiment shown in FIG. 1, five hoses may be connected at the top (108) of the connector (100) (e.g., using API connections) to fluidly connect each hose to a bore opening. In one or more embodiments, a bore opening may be a flanged opening or other fluid connection-type opening to provide connections to hoses in a riser connection. A riser connection (160) may be connected to the top (108) of the connector (100) between tow strap mounts (110), which may be connected to a towing system for helping to raise and lower the connector (100) in a connector housing (136). For example, in some embodiments, a riser connection (160) may be connected to a top (108) of a connector (100). Tow strap mounts (110) of the connector (100) may then be connected to a towing system via tow lines, which may be used to relieve tension on the line as the connector (100) is inserted into a connector housing (136). In some embodiments, tow strap mounts (110) may enable electrical connectors to be tied into the disconnect sequence of the connector (100).

Connector assemblies according to embodiments of the present disclosure may provide at least one of the following advantages over previously used or conventional riser connections. Conventional connections typically require an external structure aid the alignment process and/or the mating assemblies have to be a part of the same external structure. Conventional connections typically may only be used for small bore applications (<5⅛"). Conventional connections do not utilize a buoyancy assisted disconnect or winch assisted connection. Additionally, conventional connections do not incorporate electrical connector disconnect features or other technique for reducing tension during connection.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A system for connecting one or more flow lines, the system comprising:

a connector housing comprising a first connection passage formed through a wall of the connector housing;

a connector disposed within the connector housing;

a first annular flow path connection formed between the connector housing and the connector, wherein the first annular flow path connection is formed by a first housing annular flow path connection groove formed in an inner surface of the connector housing, a first connector annular flow path connection groove formed in an outer side surface of the connector, or a combination of the first housing annular flow path connection groove axially aligned with the first connector annular flow path connection groove; and a winching system located proximate a lower end of the connector housing, wherein the first connection passage through the connector housing intersects with the first annular flow path connection, wherein the connector has a body comprising one or more bores that each extend from an opening at a top surface of the connector to an opening at a side surface of the connector, and wherein the winching system is configured to connect the connector to the connector housing.

2. The system of claim 1, wherein the connector housing is configured to be attached to a structure for fluidly connecting a blowout preventer (BOP) stack to the connector.

3. The system of claim 2, wherein the connector housing is formed integrally with the structure.

4. The system of claim 2, wherein the connector housing is attached to the structure via a plurality of bolts or via welding.

5. The system of claim 1, wherein the connector housing includes a seal extending about a circumference of the inner surface of the connector housing to seal the first annular flow path connection.

6. The system of claim 1, wherein the connector housing is attached to an end of a frame of a BOP stack.

7. The system of claim 1, wherein:

the one or more bores comprises a first bore; and the opening at the side surface to the first bore is in fluid communication with the first annular flow path connection.

8. The system of claim 1, further comprising tow strap mounts connecting the connector to a towing system via tow lines.

9. The system of claim 8, wherein the tow strap mounts enable electrical connectors to be tied into a disconnect sequence of the connector.

10. The system of claim 1, further comprising one or more buoyancy modules attached to a top of the connector.

11. A system for connecting one or more flow lines, the system comprising:

a connector housing comprising a first connection passage formed through a wall of the connector housing;

a connector disposed within the connector housing, wherein the connector has a body comprising:

a first bore extending from a first top opening at a top surface of the connector to a first side opening at a side surface of the connector; and a second bore extending from a second top opening at the top surface to a second side opening at the side surface;

a first annular flow path connection formed between the connector housing and the connector, wherein the first annular flow path connection is formed by a first housing annular flow path connection groove formed in an inner surface of the connector housing, a first connector annular flow path connection groove formed in the side surface of the connector, or a combination of the first housing annular flow path connection groove axially aligned with the first connector annular flow path connection groove, wherein the first connection passage through the connector housing and the first side opening of the first bore each intersect with the first annular flow path connection; and a second annular flow path connection formed between the connector housing and the connector, wherein the second annular flow path connection is formed by a second housing annular flow path connection groove formed in the inner surface of the connector housing, a second connector annular flow path connection groove formed in the side surface of the connector, or a combination of the second housing annular flow path connection groove axially aligned with the second connector annular flow path connection groove; and wherein the second side opening of the second bore is in fluid communication with the second annular flow path connection.

12. The system of claim 11, further comprising:

a third bore extending through the body of the connector from a third top opening at the top surface to a third side opening at the side surface of the connector; and a third annular flow path connection formed between the connector housing and the connector, wherein the third annular flow path connection is formed by a third housing annular flow path connection groove formed in the inner surface of the connector housing, a third connector annular flow path connection groove formed in the side surface of the connector, or a combination of the third housing annular flow path connection groove axially aligned with the third connector annular flow path connection groove; and wherein the third side opening at the side surface to the third bore is in fluid communication with the third annular flow path connection.

13. A method for connecting a riser to a blowout preventer (BOP) stack, the method comprising:

providing a connector housing connected to the BOP stack, wherein the BOP stack is supported on a frame, and wherein the connector housing comprises a first connection passage formed through a wall of the connector housing;

connecting the riser to a connector via a riser connection, wherein the connector comprises a first bore formed through a body of the connector, and wherein the first bore extends from an opening at a top surface of the connector to an opening at a side surface of the connector;

inserting the connector into the connector housing, comprising:

pulling the connector into the connector housing via a winching system that is mounted on the frame, wherein a winch on the winching system connects to a lower end of the connector through the connector housing, wherein, when the connector is inserted into the connector housing, a first annular flow path connection is formed between the connector housing and the connector by a first housing annular flow path connection groove formed in an inner surface of the connector housing, a first connector annular flow path connection groove formed in an outer side surface of the connector, or a combination of the first housing annular flow path connection groove axially aligned with the first connector annular flow path connection groove, the first connection passage through the connector housing intersects with the first annular flow path connection, the first bore is in fluid communication with the first annular flow path connection.

14. The method of claim 13, further comprising:

connecting a pump to the riser, wherein the pump is configured to pump a fluid.

15. The method of claim 13, wherein inserting the connector comprises sealing the first annular flow path connection via a seal.

16. The method of claim 13, wherein:

the body of the connector comprises a second bore;

the second bore being formed through the body of the connector, and the system comprises a second annular flow path connection formed between the connector housing and the connector, wherein the second annular flow path connection is formed by a second housing annular flow path connection groove formed in the inner surface of the connector housing, a second connector annular flow path connection groove formed in the outer side surface of the connector, or a combination of the second housing annular flow path connection groove axially aligned with the second connector annular flow path connection groove.

17. The method of claim 16, wherein:

the body of the connector comprises a third bore;

the third bore being formed through the body of the connector, and the system comprises a third annular flow path connection formed between the connector housing and the connector, wherein the third annular flow path connection is formed by a third housing annular flow path connection groove formed in the inner surface of the connector housing, a third connector annular flow path connection groove formed in the outer side surface of the connector, or a combination of the third housing annular flow path connection groove axially aligned with the third connector annular flow path connection groove.

18. The method of claim 13, wherein the riser connection comprises one or more hoses that connect the riser with one or more bores of the connector.

* * * * *